United States Patent [19]

Pirwitz

[11] Patent Number: 4,766,456

[45] Date of Patent: Aug. 23, 1988

[54] RELEASE AGENT MANAGEMENT SYSTEM FOR A HEAT AND PRESSURE FUSER

[75] Inventor: Robert G. Pirwitz, Fairport, N.Y.

[73] Assignee: Xerox Corporation, Stamford, Conn.

[21] Appl. No.: 846,644

[22] Filed: Mar. 31, 1986

[51] Int. Cl.[4] ..... G03G 15/10

[52] U.S. Cl. ..... 355/3 FU; 118/60; 118/101; 118/260

[58] Field of Search ..... 355/13 FU, 14 FU; 118/60, 70, 101, 104, 260; 222/187

[56] References Cited

U.S. PATENT DOCUMENTS

| | | | |
|---|---|---|---|
| 2,975,464 | 3/1961 | Schultz | 222/187 |
| 4,182,263 | 1/1980 | Naeser et al. | 118/60 |
| 4,277,161 | 7/1981 | Calabrese | 355/3 FU |
| 4,359,963 | 11/1982 | Saito et al. | 118/60 |
| 4,378,752 | 4/1983 | Knechtel | 118/60 |
| 4,568,275 | 2/1986 | Sakurai | 29/216 X |
| 4,573,428 | 3/1986 | Ogino et al. | 118/60 |
| 4,633,805 | 1/1987 | Katsuya et al. | 118/60 |

FOREIGN PATENT DOCUMENTS

| | | | |
|---|---|---|---|
| 56-165177 | 12/1981 | Japan | 118/60 |
| 60-17472 | 1/1985 | Japan | 355/3 FU |
| 6097374 | 5/1985 | Japan | 355/3 FU |
| 60-144777 | 7/1985 | Japan | 355/3 FU |

*Primary Examiner*—A. T. Grimley
*Assistant Examiner*—Jane K. Lau

[57] ABSTRACT

A RAM system suitable for use in copier and printing machines having a relatively slow (i.e. 2 inches per second) process speed while avoiding the prior art problem of excess oil application, particularly outside the copy area. The RAM system contains a supply of release agent material which permits operation without frequent addition of oil to the supply yet without fear of oil spillage.

The RAM system comprises a very thin (i.e. 0.006 inches thick) wick one end of which contacts a supply of release agent material such as low viscosity silicone oil while an intermediate portion thereof is held in contact with a fuser roll member.

An oil reservoir containing a pad is provided. The pad serves as the supply of oil for the one end of the wick. The majority of the oil is contained in the pad, therefore, the problem of spillage found in prior art devices is obviated. The one end of the wick is disposed between the bottom of the pad and the reservoir while the rest of it extends up one vertical wall of the reservoir to a height above the top of the pad sufficient to insure movement of the oil through the wick by capillary action. From the top of the reservoir, the wick follows the outside of the vertical wall in a downward direction and is then routed adjacent the bottom thereof to an oppositely disposed vertical wall.

The wick contacts the fuser roll in an area beneath the reservoir and the reservoir is supported such that the weight thereof serves to effect pressure engagement between the wick and the fuser roll. In order to create an elongated area (nip) of contact between the wick and the roll surface a pressure deformable backing pad is provided.

9 Claims, 3 Drawing Sheets

FIG. 3
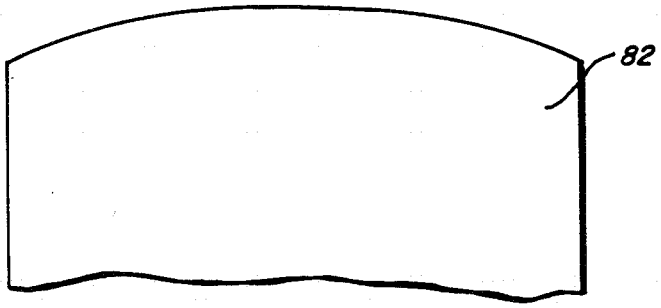
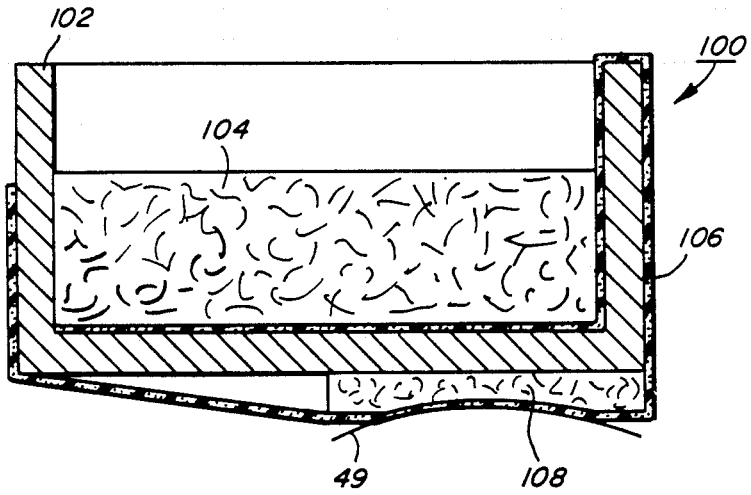
FIG. 4

RELEASE AGENT MANAGEMENT SYSTEM FOR A HEAT AND PRESSURE FUSER

BACKGROUND OF THE INVENTION

This invention relates generally to xerographic copying or printing apparatus, and more particularly, it relates to a release agent management system for a heat and pressure fuser for fixing of particulate thermoplastic toner by direct contact with a heated fusing member.

In the process of xerography, a light image of an original to be copied is typically recorded in the form of a latent electrostatic image upon a charge-retentive or photosensitive member with subsequent rendering of the latent image visible by the application of electroscopic marking particles, commonly referred to as toner. The visual toner image can be either fixed directly upon the photosensitive member or transferred from the member to another support, such as a sheet of plain paper, with subsequent affixing of the image thereto in one of various ways, for example, as by the application of heat and pressure.

In order to affix or fuse electroscopic toner material onto a support member by heat and pressure, it is necessary to elevate the temperature of the toner material to a point at which the constituents of the toner material coalesce and become tacky while simultaneously applying pressure. This action causes the toner to flow to some extent into the fibers or pores of support members or otherwise upon the surfaces thereof. Thereafter, as the toner material cools, solidification of the toner material occurs causing the toner material to be bonded firmly to the support member. In both the xerographic as well as the electrographic recording arts, the use of thermal energy and pressure for fixing toner images onto a support member is old and well known.

One approach to heat and pressure fusing of electroscopic toner images onto a support has been to pass the support with the toner images thereon between a pair of opposed roller members, at least one of which is internally heated. During operation of a fusing system of this type, the support member to which the toner images are electrostatically adhered is moved through the nip formed between the rolls with the toner image contacting the internally heated fuser roll to thereby effect heating of the toner images within the nip. By closely controlling the heat transferred to the toner, offset of the toner particles from the copy sheet to the fuser roll can be eliminated. This is because the heat applied to the surface of the roller is insufficient to raise the temperature of the surface of the roller above the "hot offset" temperature of the toner whereat the toner particles in the image areas of the toner liquefy and cause a splitting action in the molten toner resulting in "hot offset." Splitting occurs when the cohesive forces holding the viscous toner mass together is less than the adhesive forces tending to offset it to a contact surface such as a fuser roll.

Occasionally, however, toner particles will be offset to the fuser roll by an insufficient application of heat to the surface thereof (i.e. "cold" offsetting); by imperfections in the properties of the surface of the roll; or by the toner particles insufficiently adhering to the copy sheet by the electrostatic forces which normally hold them there. In such a case, toner particles may be transferred to the surface of the fuser roll with subsequent transfer to the backup roll during periods of time when no copy paper is in the nip.

Moreover, toner particles can be picked up by the fuser and/or backup roll during fusing of duplex copies or simply from the surroundings of the apparatus in which the fuser is used.

One arrangement for minimizing the foregoing problems, particularly that which is commonly referred to as "offsetting," has been to provide a fuser roll with an outer surface or covering of polytetrafluoroethylene, known by the tradename Teflon to which a release agent such as silicone oil is applied, the thickness of the Teflon being on the order of several mils and the thickness of the oil being less than 1 micron. Silicone based (polydimethylsiloxane) oils which possesses a relatively low surface energy, have been found to be materials that are suitable for use in the heated fuser roll environment where Teflon constitutes the outer surface of the fuser roll. In practice, a thin layer of silicone oil is applied to the surface of the heated roll to form an interface between the roll surface and the toner images carried on the support material. Thus, a low surface energy layer is presented to the toner before it passes through the fuser nip and thereby prevents toner from offsetting to the fuser roll surface.

A fuser roll construction of the type described above is fabricated by applying in any suitable manner a solid layer of abhesive material to a rigid core or substrate such as the solid Teflon outer surface or covering of the aforementioned arrangement.

In attempts to improve at least the perceived quality of the image fused or fixed by a heated roll fuser, such rolls have been provided with conformable surfaces comprising silicone rubber or Viton (trademark of E. I. DuPont of a series of fluoroelastomers based on the copolymer of vinylidene fluoride and hexafluoropropylene). As in the case of the Teflon coated fuser, oil release fluids such as silicone based oils have been applied to the surface of the silicone rubber or Viton to both minimize offsetting and to facilitate stripping. See, for example, U.S. Pat. No. 3,964,431. When the fuser system is one which provides for applying silicone oil to silicone rubber or Viton a relatively low viscosity silicone oil (i.e. on the order of 100–1000 cs) has most commonly been employed. The foregoing type of oil is sometimes referred to as non-functional oil as opposed to function silicone oil, the latter of which interacts with suitable metal particles contained within the rubber or Viton.

Most often, the oil is conveyed to a sump containing an applicator pad and/or roller which applies the oil to the surface of the heated fuser roll.

One of the most common prior art release agent management (RAM) systems uses a wick, one end of which contacts the fuser roll member and the other of which contacts the release agent material to be applied to the fuser member. RAM systems of the foregoing type are known to apply too much release agent or oil to the fuser roll surface, particularly in areas outside the paper path. Excess oil outside the paper path is particularly problematic in machines where various size copies are handled. Accordingly, structures such as a blade as illustrated in U.S. Pat. No. 4,087,676 issued May 2, 1978 to Yasuji Fukase is employed to control the amount of oil ultimately applied to the fuser roll to prevent offset. However, even with such a blade structure excess oil outside the paper path is still a problem and such systems are complex and costly. As described in U.S. Pat.

No. 3,883,291 issued May 13, 1975 to Cloutier et al, the oil applied to a fuser roll surface via a wick which contacts the fuser roll surface and the oil supply is controlled by an O-Ring wiper. The Cloutier device does not obviate the shortcomings outlined above.

Another RAM system wherein one end of a wick is immersed in a release fluid and the other end is in contact with the fuser roll is disclosed in U.S. Pat. No. 4,280,443 issued July 28, 1981 to Gregory V. Bogoshian. Bogoshian discloses one solution to the problem of excess oil being applied to the fuser roll. His solution is to move the wick out of contact with the fuser roll during standby periods. It is desirable to be able to control the application of release agent material with a RAM system that continuously contacts the fuser roll. While the device described in Bogoshian solves the problem of excessive oil application it is possible with such a system to apply too little oil.

Another type of prior art RAM system such as that disclosed in U.S. Pat. No. 3,884,181, comprises a supply of oil from which the oil is removed by an applicator roll and conveyed to a wick which is in contact with the fuser roll surface to which it is to be applied. A baffle member is employed to insure a supply of oil on the applicator roll. Such systems are not only complex and expensive by they do not solve the problem of excessive oil being present outside the paper path of one size document nor do they solve the spillage problem inherent in such devices.

The problem of spillage has been solved by structure such as that disclosed in U.S. Pat. No. 3,941,558 issued to Koichi Takiguchi wherein an oil impregnated web is provided for supplying the oil to the fuser roll surface. However, the cost and complexity factors are not obviated by such a structure because of the necessity of motion imparting structure for causing different sections of the web to contact the roll surface. Moreover, the quantity of oil supplied to the roll surface can not be controlled to the degree required by the application contemplated herein.

It will be appreciated that it is most desirable to supply release agent material at a rate commensurate with the machine speed in which the presently contemplated RAM system is to employed. It is further desirable to effect the desired application rate by means of a system which is simple in construction, is relatively inexpensive and which obviates the spilling problem of prior art devices. Heretofore, RAM systems of the prior art have been developed for use in machines having relatively high (i.e. above 2 inches per second) process speeds and are, therefore, inadequate to meet the requirements of the much lower rate requirements of a machine of the type in which applicant's RAM system is to be employed.

BRIEF DESCRIPTION OF THE INVENTION

As will be described hereinafter in greater detail, applicant has provided a RAM system suitable for use in copier and printing machines having a relatively slow (i.e. 2 inches per second) process speed, yet avoids the prior art problem of excess oil application, particularly outside the copy area. The RAM system disclosed herein contains a supply of release agent material which permits operation without frequent addition of oil to the supply, yet without fear of oil spillage.

To this end applicant's RAM system comprises a very thin (i.e. 0.006 inches thick) wick one end of which contacts a supply of release agent material such as low viscosity silicone oil while the other end is held in contact with a fuser roll member. The wick is fabricated from a high temperature woven Nomex fabric.

An oil reservoir containing a pad fabricated from needled felt material, the latter of which serves as the supply of oil for the one end of the wick. The majority of the oil is contained in the pad, therefore, the problem of spillage found in prior art devices is obviated. The wick is disposed between the bottom of the pad and the reservoir and extends up the side of the reservoir to a height above the top of the pad sufficient to insure movement of the oil through the wick by capillary action. From the top of the reservoir the wick follows the outside of the reservoir in a downward direction and is then routed to the other side of the reservoir adjacent the bottom thereof.

The wick contacts the fuser roll in an area beneath the reservoir and the reservoir is supported such that the weight thereof serves to effect pressure engagement between the wick and the fuser roll. In order to create an elongated area (nip) of contact between the wick and the roll surface a backing pad is provided. The backing pad is fabricated from a high (i.e. capable of withstanding the operating temperatures of the fuser) temperature elastomeric foam which is bonded to the underside of the reservoir.

BRIEF DESCRIPTION OF THE DRAWINGS

Figure 1:
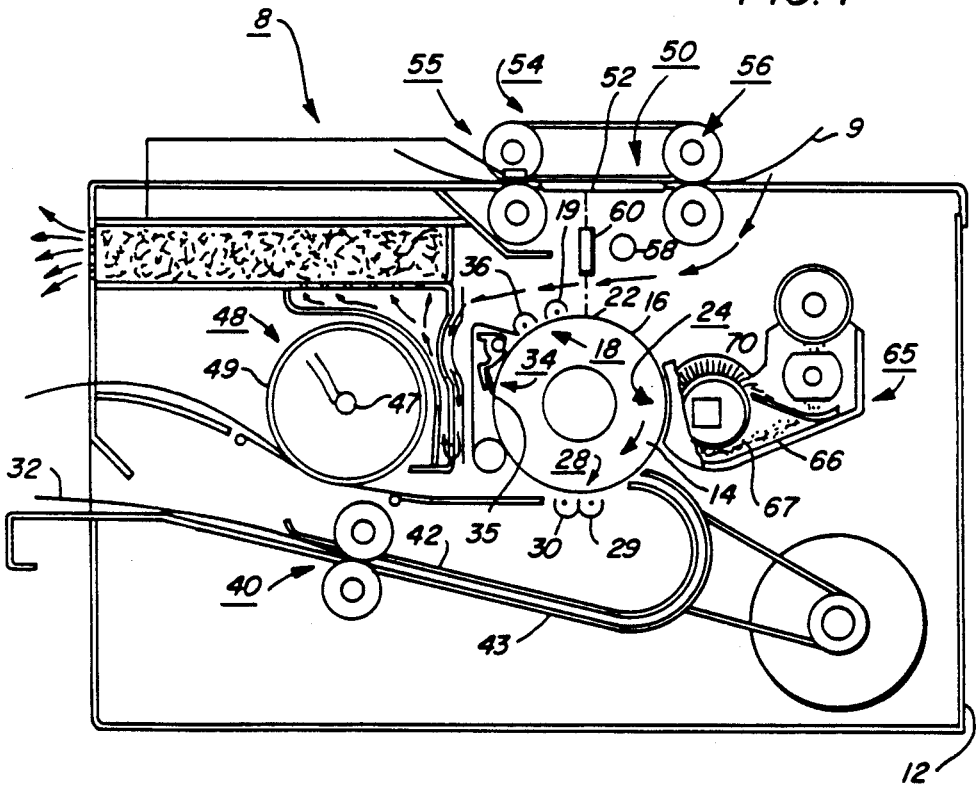
Figure 2:
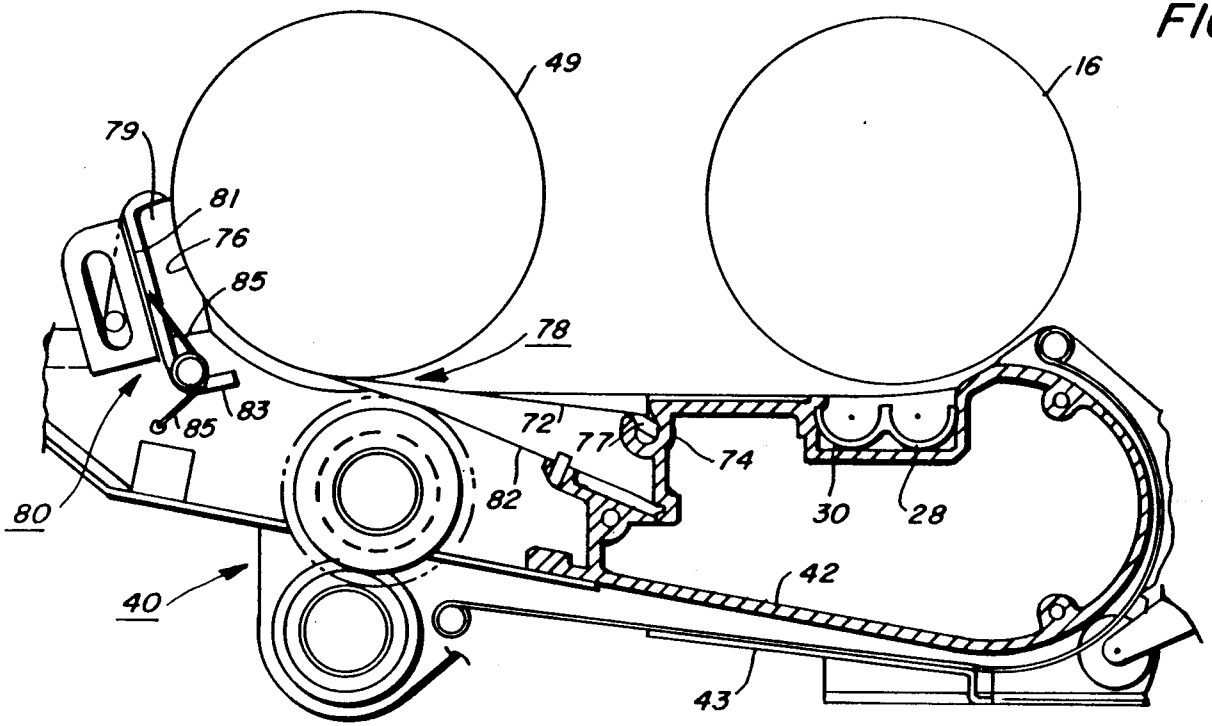

IN THE DRAWINGS:

FIG. 1 is a side view in section of a reproduction machine having the improved RAM system for a heat and pressure fuser;

FIG. 2 is a fragmentary schematic view of a heat and pressure fuser of the present invention;

FIG. 3 is a top fragmentary view of a biasing blade structure of the fuser of FIG. 2; and FIG. 4 is a cross sectional view of a release agent management system of the present invention which is rotated from between 30 to 60 degrees clockwise from its operative position as shown in FIG. 1.

DETAILED DESCRIPTION OF THE INVENTION

Referring to FIG. 1 of the drawings, there is shown a xerographic type reproduction machine 8 incorporating the present invention. Machine 8 has a suitable frame 12 on which the machine xerographic components are operatively supported. Briefly, as will be familiar to those skilled in the xerographic printing and copying arts, the xerographic components of the machine include a charge retentive recording member, shown here in the form of a rotatable photoreceptor 14. In the exemplary arrangement shown, photoreceptor 14 comprises a drum having a photoconductive surface 16. Other photoreceptor types such as belt, web, etc. may instead by employed.

Operatively disposed about the periphery of photoreceptor 14 are a charging station 18 with charge corotron 19 for placing a uniform charge on the photoconductive surface 16 of photoreceptor 14; exposure station 22 where the previously charged photoconductive surface 16 is exposed to image rays of a document 9 being copied or reproduced to thereby form a latent electrostatic image on the charge retentive surface; development station 24 where the latent electrostatic image created on photoconductive surface 16 is developed by toner; combination transfer and detack station 28 with transfer corotron 29 and and detack corotron 30 for sequentially transferring the developed image to a suitable copy substrate material such as a copy sheet 32 brought forward in timed relation with the developed image on photoconductive surface 16 and lessening the forces of attraction between the copy substrate and the charge retentive member; and cleaning station 34 with cleaning blade 35 and discharge corotron 36 for removing leftover developer from photoconductive surface 16 and neutralizing residual charges thereon.

A copy sheet 32 is brought forward to transfer station 28 by feed roll pair 40. Sheet guides 42, 43 serve to guide the sheet through an approximately 180 degree turn prior to the copy substrate reaching the transfer station 28. Following transfer, the sheet 28 is carried forward to a fusing station 48 where the toner image is contacted by fusing roll 49 forming one member of a heat and pressure fuser. Fusing roll 49 is heated by a suitable heater such as quartz lamp 47 disposed within the interior of roll 49. After fusing, the copy sheet 28 is discharged from the machine.

A transparent plate 50 supports the document 9 as the document is moved past a scan area 52 by a constant velocity type transport 54. As will be understood, scan area 52 is in effect a scan line extending across the width of platen 50 at a desired point along platen 50 where the document is scanned line by line as the document is moved along platen 50 by transport 54. Transport 54 has input and output document feed roll pairs 55,56 respectively on each side of scan area 52 for moving document 9 across platen 50 at a predetermined speed. Exposure lamp 58 is provided to illuminate a strip-like area of platen 50 at scan area 52. The image rays from the document line scanned are transmitted by a gradient index fiber lens array 60 to exposure station 22 to expose the photoconductive surface 16 of the moving photoreceptor 14.

Developing station 24 includes a developer housing 65, the lower part of which forms a sump 66 for holding a quantity of developer 67. As will be understood by those skilled in the art, developer 67 comprises a mixture of larger carrier particles and smaller toner or ink particles. A rotatable magnetic brush developer roll 70 is disposed a in predetermined operative relation to the photoconductive surface 16 in developer housing 65, roll 70 serving to bring developer from sump 66 into developing relation with photoreceptor 14 to develop the latent electrostatic images formed on the photoconductive surface 16.

The fuser roll 49 comprises a thin-walled thermally conductive tube having a thin (i.e. approximately 0.005 inch (0.01 Centimeters) coating of silicone rubber on the exterior surface thereof which contacts the toner images on the copy substrate to thereby affix them to the substrate. A release agent management system, not shown, applies a thin layer of silicone oil to the surface of the fuser roll for the prevention of toner offset thereto as well as reducing the torque required to effect rotation of the fuser roll. In one operative embodiment of the fuser roll its diameter was 3.3 inches and had a length of 40 inches. This embodiment is typically used to fuse images on copy substrates that are 3 feet (0.91 Meters) wide by 4 feet (1.22 Meters) in length.

The fuser apparatus 48 in the preferred embodiment also comprises a non-rotating, elongated pressure member 72 herein illustrated as a web or sling. The sling preferably comprises a woven fabric made from a heat resistant material that comprises the copolymer of metaphenylenediamine and isophthaloyl chloride. The sling retains its properties after long-term exposure to temperatures up to 220 degrees centigrade.

As viewed in FIG. 2, one end of the sling 72 is anchored in a frame structure 74 by means of a rectangular rod 75. The opposite end of the sling is biased into engagement with the fuser roll as indicated by reference character 76 such that the fuser roll and the sling cooperate to form an elongated nip 78 therebetween. The rod is insertable into a slot 77 when it is rotated 90 degrees from the position shown. In the position shown, the rod cannot be removed from the slot.

A pressure applying mechanism 80 comprising a plate 81 and a pad 79 creates a force between the roll and the sling so as to produce a frictional force therebetween that keeps the sling in tension so it can provide suitable pressure to the surface of the fuser roll. The pad which is relatively thick is preferably fabricated from a needled felt material. The plate 81 is pivotally mounted by a pin structure 83 and a spring structure 85 serves to bias the plate and therefore the pad 79 into its operative position.

A blade member 82 has one end anchored in the frame structure 74 while its other end contacts the sling as indicated at 84 serves to apply a load against the sling and thereby cooperate with the spring mechanism 80 to effect the required pressure in the nip for satisfactory operation. The area of contact between the web and the fuser roll forms the entrance to the nip area. The blade is preferably fabricated from thermally conductive material and is mounted such that in its free state it is flat and in its operative state the edge of the blade is deflected by the fuser roll to thereby cause it to function as a leaf spring, applying the aforementioned load against the web or sling. Edge contact of the blade produces the highest possible pressure for a given force or load. The purpose of the blade is to control paper cockle caused by the rapid drying of high moisture content paper.

As viewed from the top in FIG. 3, the blade edge has a slight curve to it. The slight curve prevents paper from stalling at the nip entrance. Stalling has been observed when using a blade with a straight edge when the lead edge of the paper arrives at and attempts to penetrate the nip at the same time. The blade is relatively thin (i.e. approximately 020 inch (0.102 centimeters) so that it can conform to minor irregularities in the roll surface. The blade is designed to have a low spring rate to preclude appreciable change in spring force due to mechanical tolerance stack-up variations.

In order to optimize paper handling a weave pattern is chosen so that the frictional force developed between the sling and the substrate is considerably lower than the frictional developed between the substrate and the roll. The foregoing optimizes the driving of the copy substrate through the nip by the fuser roll and minimizes lead edge stalling at the nip entrance.

As an alternative to using the sling, an elongated brush could be utilized. The brush has an arcuate shape in cross section so that its bristles follow the curvature of the fuser roll. Like the sling the brush which is stationarily mounted relative to the fuser roll cooperates with the fuser roll to form a lower pressure nip through which copy substrates can readily by transported by means of the fuser roll.

As shown in FIGS. 1 and 4, there is provided a release agent management (ram) system indicated by reference character 100. The ram system comprises a reservoir 102 which holds a porous pad 104 adapted to hold a quantity of release agent material in the form of a low viscosity silicone oil. The pad is fabricated from needled felt material and serves to supply oil to one end of a woven wick 106. The majority of the oil is contained in the pad, therefore the problem of oil spillage found in prior art devices is obviated.

The wick 106 is fabricated from a very thin (i.e. 0.006 inch thick) heat-resistant nylon material such as Nomex (trademark of E. I. DuPont). The wick is disposed between the bottom of the pad and the reservoir and extends up the side of the reservoir to a height above the top of the pad sufficient to insure movement of the oil through the wick by capillary action. From the top of the reservoir the wick follows the outside of the reservoir adjacent the bottom thereof.

The wick contacts the fuser roll in an area beneath the reservoir and the reservoir is supported such that the weight thereof serves to effect pressure engagement between the wick and the fuser roll. In order to create an elongated area (nip) of contact between the wick and the roll surface a deformable backing pad 108 is provided. The backing pad is fabricated from a high (i.e. capable of withstanding the operating temperatures of the fuser) temperature elastomeric foam which is bonded to the underside of the reservoir.

As can be seen in FIG. 1, the ram system 100 is supported such that a portion thereof contacts the fuser roll 49 at approximately 30 to 60 degrees to the left of top dead center as viewed in FIG. 1. The support structure for the ram 100 forms no part of the present invention, therefore, a description thereof has been omitted.

What is claimed:

1. A release agent management system for applying release agent material to the surface of a fuser roll member, said system comprising:

a rigid reservoir containing a porous member containing a quantity of liquid release agent material;

an elongated wick having one end thereof in contact with said porous member and a portion thereof positioned for contact with a fuser roll member, said elongated wick being disposed along a predetermined elongated path between said porous member and said rigid reservoir and between said rigid reservoir and a fuser roll member, said elongated wick being constructed such that release agent material is conveyed at a relatively slow rate by capillary action to thereby prevent the application of excess oil to a fuser roll member;

a deformable structure disposed between said wick and said rigid reservoir;

said rigid reservoir being supported by said deformable structure and a fuser roll member whereby said deformable structure is deformed to thereby form an elongated nip between said wick and a fuser roll member.

2. Apparatus according to claim 1 wherein the thickness of said wick is small enough to limit the flow rate of release agent material to about 0.5 micro liter per copy.

3. Apparatus according to claim 2 wherein the thickness of said wick is approximately 0.006 inch.

4. Heat and pressure fuser apparatus for fixing toner images to copy substrates, said apparatus comprising:

a fuser roll member;

means for elevating the temperature of said fuser roll member;

a pressure member having an elongated surface contacting said fuser roll member to form a nip therebetween through which copy substrates pass with toner images carried thereby contacting said fuser roll member;

a release agent management system for applying release agent material to the surface of said fuser roll member, said system comprising a rigid reservoir containing a porous member containing a quantity of liquid release agent material and an elongated wick having one end thereof in contact with said porous member and a portion thereof in contact with said fuser roll member, said fuser roll member, said elongated wick being disposed along a predetermined elongated path between said porous member and said rigid reservoir and between said rigid reservoir and said fuser roll member, said elongated wick being constructed such that release agent material is conveyed at a relatively slow rate by capillary action to thereby prevent the application of excess oil to said fuser roll members;

a deformable structure disposed between said wick and said rigid reservoir;

said rigid reservoir being supported by said deformable structure and said fuser roll member whereby said deformable structure is deformed to thereby cause an elongated nip to be formed between said wick and said fuser roll member.

5. Apparatus according to claim 4, wherein the thickness of said wick is small enough to limit the flow rate of release agent material to about 0.5 micro liter per copy.

6. Apparatus according to claim 5 wherein the thickness of said wick is approximately 0.006 inch.

7. Printing apparatus for forming toner images on copy substrates, said apparatus comprising:

a fuser roll member;

means for elevating the temperatures of said fuser roll member;

a pressure member having an elongated surface contacting said fuser roll member to form a nip therebetween through which copy substrates pass with toner images carried thereby contacting said fuser roll member;

a release agent management system for applying release agent material to the surface of said fuser roll member, said system comprising a rigid reservoir containing a porous member containing a quantity of liquid release agent material and an elongated wick having one end thereof in contact with said porous member and a portion thereof in contact with said fuser roll member, said elongated wick being disposed along a predetermined elongated path between said porous member and said rigid reservoir and between said rigid reservoir and said fuser roll member, said elongated wick being constructed such that release agent material is conveyed at a relatively slow rate by capillary action to thereby prevent the application of excess oil to said fuser roll member;

a deformable structure disposed between said wick and said rigid reservoir;

said rigid reservoir being supported by said deformable structure and said fuser roll member whereby said deformable structure is deformed to thereby form an elongated nip between said wick and said fuser roll member.

8. Apparatus according to claim 7 wherein the thickness of said wick is small enough to limit the flow rate of release agent material to about 0.5 micro liter per copy.

9. Apparatus according to claim 8 wherein the thickness of said wick is approximately 0.006 inch.

* * * * *